US006302301B1

(12) United States Patent
Vette

(10) Patent No.: US 6,302,301 B1
(45) **Date of Patent: *Oct. 16, 2001**

(54) DISPENSING CONTAINER WITH A SLIDING VALVE AND A TAMPER-PROOF DEVICE

(75) Inventor: Manfred Vette, Pr. Oldendorf (DE)

(73) Assignee: Warner-Lambert Company, Morris Plains, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/000,306

(22) PCT Filed: Jul. 19, 1996

(86) PCT No.: PCT/EP96/03184

§ 371 Date: Apr. 27, 1998

§ 102(e) Date: Apr. 27, 1998

(87) PCT Pub. No.: WO97/05034

PCT Pub. Date: Feb. 13, 1997

(30) Foreign Application Priority Data

Jul. 26, 1995 (DE) ..... 195 27 224

(51) Int. Cl.[7] ..... A47G 19/24

(52) U.S. Cl. ..... 222/142.6; 222/142.8; 222/142.9; 222/153.05; 222/153.06; 222/153.07; 222/153.14; 220/253; 220/257; 220/270

(58) Field of Search ..... 222/142.6, 142.8, 222/142.9, 153.06, 153.07, 541.1, 541.6, 541.9, 153.14; 220/253, 257, 270; 215/241

(56) References Cited

U.S. PATENT DOCUMENTS

| | | | | |
|---|---|---|---|---|
| 1,515,513 | * | 11/1924 | Moriarty | 222/146.2 X |
| 1,826,539 | * | 10/1931 | Harris | 222/142.9 |
| 2,262,897 | * | 11/1941 | Lewis | 222/142.9 |
| 2,349,724 | * | 5/1944 | Henderson | 222/142.9 |
| 2,361,464 | * | 10/1944 | Edwards et al. | 215/253 X |
| 2,469,034 | * | 5/1949 | Garris | 222/142.9 |
| 2,660,344 | * | 11/1953 | Starner | 222/548 |
| 2,969,895 | | 1/1961 | Rocki | 220/257 |
| 5,108,003 | | 4/1992 | Granofsky | 220/257 |
| 5,544,770 | * | 8/1996 | Travisano | 215/230 |

* cited by examiner

*Primary Examiner*—Kenneth Bomberg
(74) *Attorney, Agent, or Firm*—Darryl C. Little; Evan J. Federman

(57) ABSTRACT

A packaging container (1) with at least one partition for uptake of pourable products, which has one opening (9) which can be aligned with an opening (16) in a cover member (3). A sealing strip (4) is also applied onto a label (5) which is applied onto an actual container (2) and onto a cover member (3) such that it prevents movement of a container (2) and a cover member (3) in relation to each other and also hygienically covers an opening (16) in a cover member (3).

25 Claims, 3 Drawing Sheets

DISPENSING CONTAINER WITH A SLIDING VALVE AND A TAMPER-PROOF DEVICE

The present invention concerns a packaging container with a closure means.

BACKGROUND OF THE INVENTION

Different means have been proposed in state of the art technology in order to prevent unwanted opening of a packaging container and/or, in a case of unauthorised opening, to make this opening process irreversible and therefore show this to subsequent users. Such sealing plays a particularly large part in packaging of foodstuffs, where particularly hygienic conditions are involved and where product consumers want to be sure of obtaining undamaged and irreproachable goods.

With use of containers as packaging, particularly for pourable goods such as spice powders, herbs or powder-form foodstuffs, there are primarily two sealing methods which are known. With first such sealing, a paper or plastic strip is stuck onto an actual container and onto a screwed-on or rotated cover, in order to prevent movement of a container and a cover relative to each other. Such seals nevertheless have a general disadvantage that they only connect a part of a cover and of a container to each other, such that it is possible for these to be removed and replaced without any trace of this being left. In packaging containers in which a cover member has one or more openings which can be aligned with corresponding openings in an actual container, to pour out a pourable product contained in it, unhygienic soiling of these cover openings is not prevented. A further disadvantage with curved sides is that removal of an adhesion-seal is more difficult for a user. In a case of a said second implementation of state of the art, a seal is stuck on over pour-openings. This seal can either be positioned under a screw-type or inserted cover, which acts as a mechanical closure of a packaging container concerned, or on a cover of a type mentioned above, provided with above-mentioned openings. In a first case, a buyer or user of a product can only see whether a seal has been removed or handled after unscrewing or removing a cover, and in a second case, movement of a cover is not eliminated, such that a cover concerned, if it can be removed for refilling, can actually be removed and replaced without a seal being damaged. In this case also, a customer cannot see whether a packaging container has been handled.

Therefore, there is still a need for a removable closure means, such as a seal for example, which prevents opening of a packaging container with cover openings, and which also ensures a hygienic state of cover openings, and irreversibly shows handling by a customer.

SUMMARY OF THE INVENTION

The present invention is therefore aimed at production of closure means, on a packaging container, which prevents opening of a packaging container and also functions as an indicator of intactness of a packaging container concerned, and simultaneously hygienically seals openings in a cover member of a packaging container.

This aim is achieved by production of a packaging container with a closure means in accordance with independent claim 1. Further advantageous designs of a present invention follow from dependent claims, description and annexed diagrams.

A packaging container in accordance with a present invention is as follows:

- an actual container (hereafter referred to as a 'container') for pourable products or goods such as spices, flours, dried fishfood, etc. A container concerned has, for example, in a main surface, its upper surface for example, one or more openings through which a pourable product can be poured.
- a closure member, such as a cover for example, which is connected to an actual container and/or to a closure means, such that movement of a closure member and a container in relation to each other is prevented.

A pourable product can be removed from a packaging container concerned, by aligning openings in a container and a closure means, insofar as sealing means have been removed, whereupon, by inclining a packaging container concerned, a pourable product flows out under gravitational force.

An actual container concerned can have any appropriate form which serves application of a closure means and movement of closure means and of a container in relation to each other. A top surface, of a container concerned, with openings, can therefore be rectangular, square or quadrangular for example, hexagonal or curvilinear, oval-shaped or circular for example. In particularly favoured implementations of a present invention, a top surface of a container with openings is either circular or hexagonal. A container concerned is therefore preferably cylindrical or six-sided in form.

A container concerned can nevertheless have a top face which is different in size to an opposite face, such that a truncated cone-shape results, for example.

At least one side of a container concerned has at least one opening through which a pourable product can flow. It is nevertheless also possible to have several openings in this face. These can, for example, be of different sizes, in order to enable selection of one particular opening for pouring a very small quantity, for example. Such openings can be implemented as groups of holes, for example, such that variation of a quantity poured is possible by means of different numbers of holes or different sizes of holes poured through.

These holes can have different forms for specific purposes. It can, for example, be preferable for them to be circular or even oval, rectangular, or for them to have another form.

The number and size and form of holes can likewise be determined by a type of pourable product concerned. It can therefore happen that another form, size or number of openings proves useful for one pourable product than for another.

The container concerned can be provided with internal partitioning forming several separated container-sections. This facilitates simultaneous enclosure of different poured products in one container. In such a case, each partition must have at least one opening on a top face to enable selective extraction of a product.

In a case where several openings are disposed in a top face, a cover member of a packaging container can be moved such that in each case one of openings in a main side can be brought into alignment with an opening in a closure member. Insofar as openings are associated with different partitions, it is also possible to arrange these openings of a main surface, or to arrange an opening in a closure member such that simultaneous pouring of flowing products from more than one partition is possible, in order to mix these.

As described above, with arrangement of partitioning in a container concerned, this partitioning can be arranged such that they lie, with one side, on a top side of a container, such that their openings all lie on this top side. It is nevertheless also possible to introduce cross-walls such that openings lie on different sides of a container. It is possible, for example, to dispose a cross-wall parallel to a top face, in order to divide a container into two container sections. In this case an opening can be provided on a top side and an opposite second side.

Therefore, there are accordingly two cover members, one on a top face and one on a base surface. A container concerned can furthermore be provided with further openings enabling it to be filled with poured products in filling machinery. These openings are preferably larger than openings for a user to pour a product concerned through, in order to speed up a filling process as much as possible. In one preferred implementation of a present invention, a base, opposite a top face, can be removed so that a container concerned is accessible for filling over its whole base surface. This base can be attached, by known measures, to a container, glued, held under tension or fused on, for example.

Immediately opposite a top face, a cover member of a packaging container concerned is applied. A cover member concerned can have a form which exactly covers a form of a covered top face, nevertheless it can also be implemented smaller, leaving a section of a top face uncovered. Whatever, it must be shaped and proportioned such that it can cover all openings, in a top face, in at least one position, in order to prevent unwanted emptying of a flow-product, after removal of sealing, and must have positions in which all openings in a top face are selectively aligned with an opening in a said cover member, in order to enable pouring of a flow-product from all openings.

To ensure functioning of a cover member, this must lie directly on a facing side of a top face of a container, in order to avoid lateral emptying of a flow-product from openings covered by a cover member. A cover member concerned can, as seen in a side view, be developed as a flat disc or preferably as a lid with a cover and a lateral skirt section which reaches as far as at least a part of side-walling of a container concerned.

The cover member concerned can be connected to a container concerned by means of a rotating journal, insofar as a rotational movement is provided for as a part of closure. Such a rotation-journal can, for example, be disposed, as a single piece, as a projection in a centre or in a corner of a cover and through a thickening at its end which is guided through a corresponding hole in a top face of a container concerned, which is prevented from sliding out of a said hole, in order to thereby ensure problem-fee fitting of a cover member on a container. A cover member concerned can also be connected to a container by means of a groove and rim arrangement. With this, grooves or rims can be disposed on an upper edge of at least a section of side-walling of a container, in which corresponding lateral grooves and rims of a cover member engage when a said cover member is applied. Depending on a form of a container concerned and arrangement of grooves and of rims, this design enables rotational movements of a cover member and a container in closing towards each other, or lateral sliding of cover member and container. In this way, with circular development of a top face, it is possible, in a particularly favoured implementation, to arrange a rim, around a circular lateral wall, in which a rim engages on a skirt section of a cover such that a cover can be turned at will through an angle of 360 degrees in relation to a container concerned. It is also possible for example to apply a groove and rim arrangement of a container, on a raised section in a centre of a top face. With this design, a cover member has a recess, in its centre, facing a top surface, or it has an opening passing through it in which a raised section of a top face can engage. In this design, openings in an upper face are positioned grouped around a raised section for example. Rims can be produced separately and be attached onto a cover member and/or onto a container using known measures, or they are developed as a single piece with a cover and/or a container.

Container and cover member can be designed such that, for example, it is possible to remove a cover member several times, without damaging a cover or a container, to fill a container concerned with a flow-product. Furthermore, container and cover member can be provided with a projection and a recess corresponding with it in a second member, enabling arresting of a cover member in relation to a container in one position, after removal of a seal, all openings in a top face of a container being covered in a said one position.

A seal concerned can be attached onto a container and a cover member simultaneously. This prevents movement of a cover and a container in relation to each other, such that these cannot be brought into a position in which a minimum single opening is brought into alignment with an opening or openings in a top face of a container, such that no pour-product can flow out. A seal concerned is applied as part of a filling process, during, before or after filling, and thereby also serves as an indicator showing fullness with and intactness of a flow-product, in a packaging container concerned. A consumer thereby obtains sureness when purchasing a product.

In a favoured implementation, a seal additionally closes an opening in a cover member, in order to avoid soiling of a pour-opening.

A clasp-zone which enables simple removal of a seal by an end-user, can additionally be disposed on a seal. In a preferred implementation, this clasp-zone is identical with an area of a seal which closes an opening or openings in a cover member. This design is favourable as a closure area is distinctly visible and a clasp-function is therefore easily understood by a user, and a closure zone is particularly accessible. In addition, cost of materials is reduced.

Different forms and designs of a seal are possible within scope of a present invention. A seal concerned can, for example, connect a container to a cover member over a peripheral section of a cover member concerned or, in a particularly favoured implementation, over a whole periphery. In addition, a seal can extend as far as sides of a container concerned.

A seal concerned can comprise a single or several sections. It can, as a strip, extend off from a cover member. Several clasp-zones can be provided, preferably where a seal comprises several sections. Likewise, several zones for covering openings in a cover member can be provided.

Seal means are preferably implemented as a sealing strip. This can favourably be manufactured from a flat material, such as paper, sheet-polymer or an adhesive film. This design enables a particularly flexible and variable application of a seal concerned onto a container and a cover member. A packaging container in accordance with a present invention can moreover be provided with a product label. Such a label can be applied onto one or more sides of a container, or enclose a container within a whole periphery of lateral walls.

In a preferred implementation of a present invention, sealing means, developed as a sealing strip, and a label, can be developed as a single element, that is, an initial piece. In this case, a seal strip is detachably connected to a label in that a perforation is punched or a line of weakness is scratched into an initial piece separating an area of a sealing strip from that of a label. This perforation or line of weakness acts as a set line of tearing, along which a seal is detached from a label when it is removed. In addition a sealing strip and label can be applied onto a cover member and a container such that an area of releasable attachment mainly lies over a transition from a cover member to a container. With this, movement of a cover member and a container is prevented by a releasable connection. A single-piece design concerned facilitates simultaneous application of a label and sealing strip and enables simpler and more precise positioning of a sealing strip because of a normally greater extension of a label in relation to that of a sealing strip concerned. Labels with attached sealing strips concerned can be punched out of larger sheets or webs. In such a case, punching out and perforation or scratching in can favourably occur in one process.

Illustrations as follows, are to explain some preferred design implementations of a present invention:

DETAILED DESCRIPTION OF THE PREFERRED EMBODIMENTS

Figure 1:
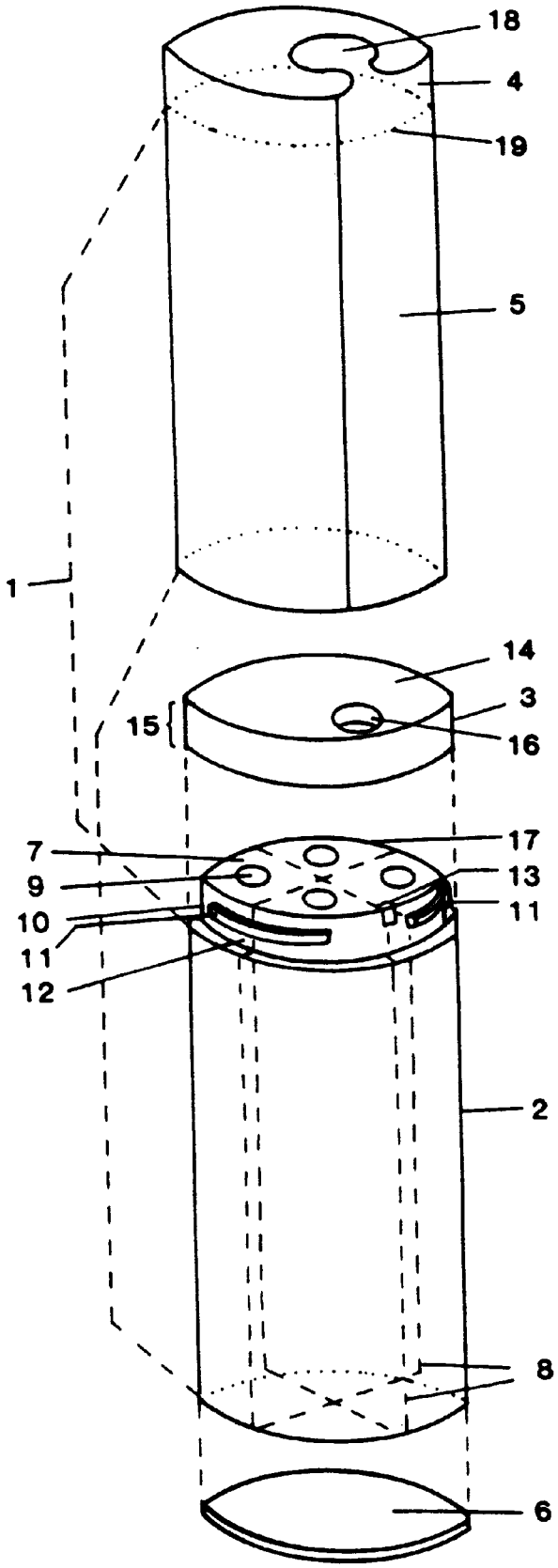
FIG. 1 an exploded view of a first preferred design of a present invention with a cylindrical container and a rotating member, FIG. 2 an exploded view of a second preferred design of a present invention with a hexagonal container and a rotating cover member, FIG. 3 an exploded view of a third preferred design of a present invention with a rectangular container and a sliding cover member.

FIG. 1 shows a first design of a present invention. A packaging container marked overall as 1 comprises a container 2 for uptake of a poured product, a cover member 3, a second cover member, namely a base 6 of a container 2, a seal 4 and a label 5.

A container 2 is a hollow cylinder and has a first side 7 which is a top face.

Four lengthways running partitions or sections are separated by two cross-shaped intermediate walls 8 (shown as a dashed line) disposed inside a container. Four circular openings 9 are disposed on a first side 7 and lead to one of partitions. There is an indentation 10 running around a side wall of a cylinder concerned, bordering directly on a first face 7. Rims 11 disposed on this divide up groove-like zones 12. Notching 13 is furthermore disposed in an area of indentation.

A container 2 concerned can be manufactured from materials which are generally known in packaging technology. It can, for example, be pressed out of synthetic material. A single-piece design of all characteristics of a container concerned is additionally preferred.

A cover member 3 encloses a flat cover member 14 and a circular skirt 15, extending downwards, disposed on a periphery of a cover member 14. An inner diameter of a skirt 15 substantially corresponds to an outer diameter of an indentation 10 of a container 2. A rim (not shown) is disposed on an inner periphery of this skirt member 15, on its lower end. There is, furthermore, an opening 16 disposed in a cover member. In a present implementation an opening concerned has a same form and size as an opening 9 in a container concerned.

If a cover member 3 is set on a container 2, rims on an inner periphery of a skirt member 15, engage in a groove-zone 12, thereby securing a cover member against falling off from a container concerned. In this position, a cover member 14 lies directly on a first face 7, in order to ensure reliable closure of openings 9. A cover member concerned can rotate through 360 degrees, such that an opening 16 can be aligned with each of openings 9.

Openings 9 and 16 are accordingly disposed such that they are all equidistant from a rotational centre of a cover 3 and a container 2. At least two openings 9 are moreover separated from each other such that a further zone 17 results which is wider than a diameter of an opening 16.

There is, furthermore, a bulge (not shown) on an inner periphery of a skirt 15. This is disposed relative to an opening 16 such that it engages, with rotation of a cover member, in indentation 13, when an opening 16 comes to lie over a further zone 17. In this way, a cover member is arrested in a position in which all openings 9 are closed. Indentation 13 and bulging in a skirt member are proportioned such that a user must apply a slight force in order to disengage these two elements.

In a present invention, a seal 4 is implemented as a sealing strip. This sealing strip 4 has an elongated form of substantially constant width, and has a laterally projecting zone 18 at one of its ends. A sealing strip 4 is disposed on a container 2 and on a cover member 3, such that it covers a join, formed between a main section of a cylinder 2 and a lower edge of a skirt-member 15, substantially over its whole length, whereby it runs parallel to this join and to a cover section 14 of a closure means. A laterally projecting zone 18 runs along a skirt member 15 in a direction of a cover member 14, flaps onto a rim between a skirt member 15 and a cover section 14 and, with its end area, closes an opening 16. This end area is favourably broader than a shoulder of a laterally projecting zone 18, in order to reliably close an opening 16. This end zone of a laterally projecting zone 18 simultaneously serves as a clasping section when a sealing strip 4 is removed. A seal strip 4 concerned is produced from sheet polymer. It is coated with ordinary adhesives on a side facing a packaging container 1, so that it can be connected, over its full surface-area, to a container 2 and a cover member 3.

A label 5 is furthermore disposed on a container concerned. This is essentially rectangular in form and covers most of cylindrical sides of a container 2, as it is wound once round this. A label concerned can be printed on, showing goods contained in a container and/or partitions and giving details of a company concerned, plus further information, or showing graphic elements.

In a design concerned here, a label is likewise implemented as a single-piece together with a sealing strip, and is made of sheet-polymer. Sealing strip 4 and label 5 are detachably connected by means of a tearing line 19. A tear-line concerned can, for example, be developed as a line of weakness through indentation on a film concerned. Alternatively, a tear-line can be produced by a line of perforations in sheet-polymer. A combination of both processes is also possible.

A side opposite a top face of a cylindrical container is omitted in a present design. Instead, a groove is provided, on an inner rim of a periphery of a lateral surface, in which a base 6 with a corresponding rim or its lateral rim can engage. A base can be attached, with usual means, to a lateral surface, by means for example of tensioning or retaining forces of a groove concerned, through adhesion or fusion.

Evidently, an implementation described above can be modified. Either more or fewer partitions can be included. Each partition can have one or several openings 9. A rotation journal can also be used in place of a rim-groove system.

When manufacturing seals, an angle of rotation concerned can be limited to less than 360 degrees. A seal strip 4 can be guided over only a section of a periphery of a cylinder concerned. A laterally projecting zone does not have to end in an end area, instead it can, for example, extend bow-shaped over a whole cover section.

Figure 2:
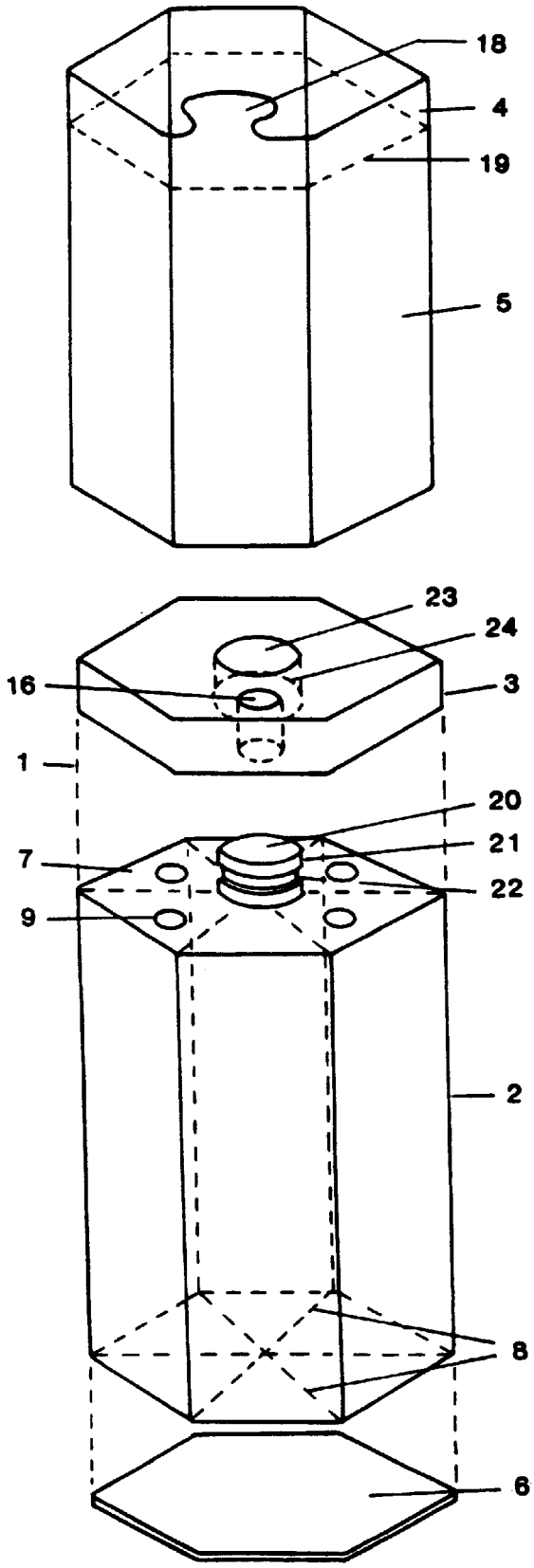

FIG. 2 shows a design of a present invention, in which a hexagonal container is produced. Identical reference numbers indicate identical characteristics as for FIG. 1.

A container 2 is hexagonal and has a first face 7 which, in a normal position, is its top face, and which is hexagonal in plan view. A total of six lengthways sections or partitions are separated by three intermediate walls 8 (shown by a dashed line) disposed lengthways inside a container 2. Five circular openings 9 are disposed on a top face 7, each leading to one partition and each equidistant from a central point of a top face.

In a centre of a top face there is a raised member 20 which is provided on its side wall 21 with a surrounding groove 22. A cover member 3 is likewise hexagonal in form and has a same size as a top face 7 of a cylindrical raised member 20 on a top face 7. In its centre, a cover member 3 has a circular central opening 23 passing through its whole thickness, an inner diameter of a said hole substantially corresponding to an outer diameter of a cylindrical raised member 20 on a top face 7. A circular rim is disposed on an inner periphery of this central opening 23, this rim being separated from a surface of a cover member facing a top face 7 exactly as a groove 22 is separated, from a top face 7, in a cylindrical, raised member 20.

If a cover member 3 is set on a container 2, a rim 24 engages, on an inner periphery of a central opening 23, in a groove 22 of a raised member 20 and thereby secures a cover member 3 against falling from a container 2. In this position, a surface of a cover member 3 facing a top face 7 must lie directly on a said top face 7, in order to ensure reliable closure of openings 9. A cover member 3 can rotate through an angle of 360 degrees such that an opening 16 can be aligned with any one of openings 9. An indentation 13 and a corresponding bulging in a cylindrical raised member 20 and a central opening 23 enable at least one position of a cover member and a top face 7 in relation to each other in which all openings 9 are closed.

In a design shown here, a partition which has no opening 9 is not designed for uptake of a flow-product. With this, a position for closure of all openings 9 can be appropriately chosen such that an opening 16 in a cover member comes to lie over this partition.

FIG. 2 further shows a seal in accordance with a present invention as a sealing strip 4 which is detachably connected to a label 5. Mounting of a label 5 and seal 4 substantially corresponds to that shown in FIG. 1.

Different variations are also possible with this design. A rim and groove system as shown in FIG. 1 can be used. Numbers of partitions can be reduced or increased, and a number of partitions present can differ from a number of sides of a container concerned, or all partitions can be used, etc.

Figure 3:
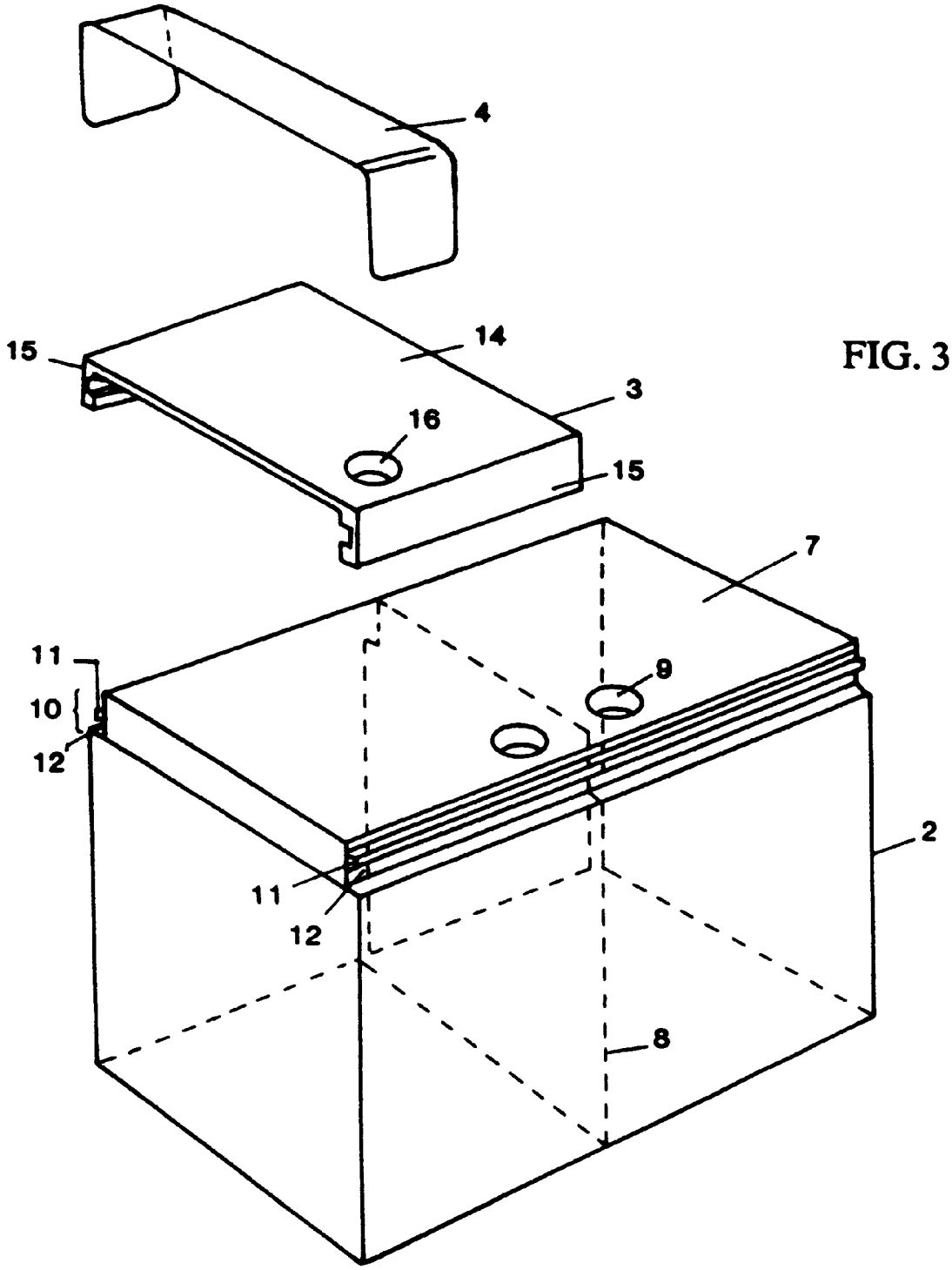

FIG. 3 shows a further design of a present invention, for which a square packaging container is produced. Identical referral numbers show same characteristics as in FIG. 1.

A container 2 has, in plan view, a square contour. In a present invention, an intermediate wall 8 serves to divide two sections or partitions, having a same or different sizes, which each have an opening 9 on a top face 7. A container 2 has two indentations 10' with rims 11' and groove-like zones 12'. A cover member 3 comprises a square cover section 14 and two skirt sections 15' which are disposed as in FIG. 1. When a cover member concerned is placed on a container 2, rims and grooves have a same function as in FIG. 1 and enable lateral movement of a cover member 3 on a container 2. In this way, by movement of a cover member 3 with an opening 16 aligned with one of openings 9, a flow-product is poured. A cover member 3 can also be brought into at least one position in which all openings 9 are covered by a cover section 14.

In a design shown in FIG. 3, a sealing strip 4 is developed as a strap which extends from a longitudinal side wall over a skirt section 15' associated with this side wall, a cover section, a skirt section 15' of another side wall and over this other longitudinal side wall, whereby a sealing strip also cover an opening 16 in a cover member. Here, a cover member is in an arrestable initial position in which all openings 9 are covered.

Different variations are also possible with this design. A container concerned can be implemented without intermediate walls, for example. A sealing strip, similar to that shown in FIG. 1, can also be guided around all four sides of a container 2, or it can, at least in a zone of transition from a skirt member to a container, be so broad that it covers a whole join over a whole width of a skirt-section. Sealing strips can also have separate, laterally projecting zones serving as clasps and/or covering an opening 16 which is disposed such that it can be moved. As a further variation, it is conceivable that only one skirt-member be secured with a sealing strip.

In an example as shown in FIG. 3, a sealing strip is shown as a unity separated from a label 5. It is nevertheless also possible, as in FIG. 1, to develop label and seal-strip as a single piece.

What is claimed is:

1. A packaging container, comprising:

a container for holding at least one bulk material, the container having a plurality of intermediate walls which form partitions inside the container and at least one top face having at least one opening to at least one of the partitions;

a closure movably connected to the container, the closure having at least one opening which can at least partly be brought into register with the at least one opening of the at least one top face of the container for release of the bulk material; and at least one seal which is mounted on the container and on the closure and which seals the closure and the container relative to each other, so that movement of the closure and container relative to each other is possible only after removal or destruction of the seal, wherein the seal has a region which closes the at least one opening on the top face and is removable to open the at least one opening on the top face and wherein the seal provides a gripping region to facilitate movement of the seal.

2. A packaging container according to claim 1, wherein the seal connects the container to the closure over the entire circumference of the closure.

3. A packaging container according to claim 1, wherein a portion of the seal extends as a stirrup-shaped piece over the closure.

4. A packaging container according to claim 1, wherein the seal consists of a single piece.

5. A packaging container according to claim 4, wherein the seal is releasably connected/fixed by a predetermined tear region to a label applied to the container and the top face of the container where the top face adjoins the container.

6. A packaging container according to claim 5, wherein the seal and label consist of one piece and the predetermined tear region is a perforation.

7. A packaging container according to claim 5, wherein the seal and label consist of one piece and the predetermined tear region is a notched line to weaken the material.

8. A packaging container according to claim 5, wherein the seal and label are adhesively joined together in the predetermined tear region.

9. A packaging container according to claim 5, wherein the seal is a polymer film.

10. A packaging container according to claim 5, wherein the seal (4) is a laminated film.

11. A packaging container according to claim 5 to wherein the seal is paper.

12. A packaging container according to claim 5, wherein the container comprises a plurality of partitions which form different compartments separate from each other in the interior of the container, which compartments each comprise at least one opening on the in the at least one top face.

13. A packaging container according to claim 12, wherein the at least one opening of the closure can be at least partly brought into register in each case only with the at least one opening of one of the compartments, while the at least one opening of the other compartments are closed by the portion of the closure not provided with openings.

14. A packaging container according to claim 13, wherein the at least one opening of the container is of essentially the same size and shape as the at least one opening in the closure.

15. A packaging container according to claim 13, wherein the at least one opening in the closure comprises several adjacent openings which can be brought into register with the at least one opening in the top face of the container.

16. A packaging container according to claim 13, wherein the closure comprises several groups of adjacent openings, wherein the groups differ in number of adjacent openings and in their diameter, wherein in each case one of the groups of openings can be brought into register with the at least one opening in the top face of the container.

17. A packaging container according to claim 13, wherein the container has an essentially curvilinear shape.

18. A packaging container according to claim 13, wherein the container has a circular shape.

19. A packaging container according to claim 12, wherein the closure is removable to allow filling with the at least one bulk material through the at least one opening of the first side.

20. A packaging container according to claim 12, wherein the closure is rotatably connected to at least the top face of the container.

21. A packaging container according to claim 20, wherein the closure further comprises an apron which extends around at least a portion of the side walls.

22. A packaging container according to claim 12, wherein the closure is connected to the container by a pivot pin.

23. A packaging container according to claim 12, wherein the closure is connected to the container by a plurality of grooves and a plurality of rails.

24. A packaging container according to claim 12, wherein the closure at a predetermined location of its inner circumferential edge comprises a projection which can be engaged with at least one recess at the circumference of the container in such a way that the closure can be locked relative to the container in at least one position.

25. A packaging container according to claim 24, wherein the locking takes place in such a way that none of the at least one opening in the container is at least partially in register with any of the at least one opening in the closure.

* * * * *